US010038280B2

(12) United States Patent
Schaefer et al.

(10) Patent No.: US 10,038,280 B2
(45) Date of Patent: Jul. 31, 2018

(54) CABLE LATCH INDICATOR AND RETAINER

(71) Applicant: International Business Machines Corporation, Armonk, NY (US)

(72) Inventors: Paul W. Schaefer, Rochester, MN (US); Sandra J. Shirk/Heath, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 64 days.

(21) Appl. No.: 15/010,047

(22) Filed: Jan. 29, 2016

(65) Prior Publication Data

US 2017/0222365 A1 Aug. 3, 2017

(51) Int. Cl.
*H01R 13/639* (2006.01)
*H01R 43/00* (2006.01)

(52) U.S. Cl.
CPC ..... *H01R 13/639* (2013.01); *H01R 43/00* (2013.01)

(58) Field of Classification Search
CPC ..... H01R 13/6271; H01R 13/639
USPC ..... 439/350, 351, 352, 353
See application file for complete search history.

(56) References Cited

U.S. PATENT DOCUMENTS 5,211,572 A * 5/1993 Comstock ..... H01R 13/6392 439/352
5,683,264 A 11/1997 Hobgood et al.
6,361,346 B1 * 3/2002 Matsuoka ..... H01R 13/65802 439/352
6,860,749 B1 * 3/2005 Wu ..... H01R 13/6275 439/352
7,001,222 B2 2/2006 Mazzullo et al.
7,023,703 B2 4/2006 Peloza
7,114,980 B1 * 10/2006 Wu ..... H01R 13/6275 439/352
7,318,740 B1 * 1/2008 Henry ..... H01R 13/6275 439/352
7,354,292 B1 * 4/2008 Lloyd ..... H01R 13/6272 439/352
7,473,124 B1 * 1/2009 Briant ..... H01R 13/629 439/352
7,503,793 B2 * 3/2009 Morello ..... H01R 13/6272 439/352
7,540,755 B1 * 6/2009 Wu ..... H01R 13/6275 439/352

(Continued)

*Primary Examiner* — Tulsidas C Patel
*Assistant Examiner* — Marcus Harcum
(74) *Attorney, Agent, or Firm* — ZIP Group PLLC; Matthew C. Zehrer

(57) ABSTRACT

A cable seating indication and retention system includes a cable connected to a latch that may be positioned in an engaged position or a disengaged position by a user manipulating a handling tab. To seat the cable to an electronic system, the handling tab is manipulated to position the latch in the disengaged position so that the cable may be seated to the electronic system. Once the cable is initially seated, the handling tab may be manipulated to position the latch in the engaged position to engage and retain the latch to a connector shell of the electronic system. The relative location of the handling tab, whether it be manipulated to position the latch in the engaged position or the disengaged position, provides a visible indication to a user whether the cable is properly seated.

17 Claims, 5 Drawing Sheets

(56) References Cited

U.S. PATENT DOCUMENTS

| | | | | |
|---|---|---|---|---|
| 7,572,138 | B1 * | 8/2009 | Wu | H01R 13/6275 439/352 |
| 8,337,240 | B2 | 12/2012 | Feldmeier et al. | |
| 8,444,430 | B2 * | 5/2013 | Kappla | H01R 13/6275 439/352 |
| 8,475,197 | B2 * | 7/2013 | Zerebilov | H01R 13/6275 439/352 |
| 8,475,199 | B2 * | 7/2013 | Wang | H01R 13/6275 439/160 |
| 8,550,848 | B2 * | 10/2013 | Wu | H01R 13/6583 439/353 |
| 8,905,442 | B2 * | 12/2014 | Ishigami | H01R 13/627 292/128 |
| 8,905,777 | B2 * | 12/2014 | Zhu | H01R 13/62 439/352 |
| 8,968,021 | B1 | 3/2015 | Kennedy et al. | |
| 9,219,333 | B2 * | 12/2015 | Wang | H01R 13/6275 |
| 2008/0050961 | A1 * | 2/2008 | Johnson | H01R 13/6275 439/352 |
| 2009/0176399 | A1 | 7/2009 | Desrosiers et al. | |
| 2010/0029126 | A1 | 2/2010 | Ngo | |
| 2011/0039439 | A1 | 2/2011 | Crofoot et al. | |
| 2011/0177699 | A1 | 7/2011 | Crofoot et al. | |
| 2014/0220808 | A1 | 8/2014 | Fuehrer et al. | |
| 2014/0302694 | A1 * | 10/2014 | Qiao | H01R 12/7023 439/78 |

* cited by examiner

CABLE LATCH INDICATOR AND RETAINER

FIELD OF THE INVENTION

Embodiments of the invention generally relate to electronic systems and more particularly to indicating a cable is properly connected to an electronic system while retaining the connected cable until the cable is deliberately removed.

DESCRIPTION OF THE RELATED ART

Many cables utilize a mechanical latch to retain the cable to the electronic system connector. However, in many applications it is difficult to confirm whether the cable is adequately seated to the electronic system connector without risking potential damage to the cable or electronic system connector.

SUMMARY

In an embodiment of the present invention, a cable assembly includes an inner backshell that connects a cable that extends from a cable-side of the inner backshell to a connector that extends from a connector-side of the inner backshell, a handling tab, a latch, and a pivot. The inner backshell includes a slot recessed from an upper side of the inner backshell and extends between the cable-side and connector side of the inner backshell. The inner backshell also includes a dual-position receptacle recessed from the upper side of the inner backshell and is contiguous with the slot. The handling tab is positioned within and is slideable against the slot and extends from the cable-side of the inner backshell. The handling tab includes a projection that fits within the dual-position receptacle and a windowed flange that extends from the connector-side of the inner backshell. The latch includes a ramp portion within the window of the windowed flange and a protrusion at the distal end of the latch. The pivot contacts the latch between the ramp portion and the protrusion.

In another embodiment of the present invention, an electronic system includes a electronic system connector accessible from the electronic system perimeter, an electronic system connector shell associated with the electronic system connector, and a cable assembly. The electronic system connector shell includes a receiving feature. The cable assembly includes an inner backshell that connects a cable that extends from a cable-side of the inner backshell to a connector that extends from a connector-side of the inner backshell, a handling tab, a latch, and a pivot. The inner backshell includes a slot recessed from an upper side of the inner backshell and extends between the cable-side and connector side of the inner backshell. The inner backshell also includes a dual-position receptacle recessed from the upper side of the inner backshell and is contiguous with the slot. The handling tab is positioned within and is slideable against the slot and extends from the cable-side of the inner backshell. The handling tab includes a projection that fits within the dual-position receptacle and a windowed flange that extends from the connector-side of the inner backshell. The latch includes a ramp portion within the window of the windowed flange and a protrusion at the distal end of the latch. The protrusion is configured to engage the receiving feature when the cable connector is seated with the electronic system connector. The pivot contacts the latch between the ramp portion and the protrusion.

In yet another embodiment, a method of fabricating a cable assembly includes attaching a pivot into a lower portion of an outer backshell, positioning cabling into the lower portion of the outer backshell, positioning a ramp portion of a latch within a window of a handling tab, positioning the handling tab into a slot of an inner backshell thereby retaining the latch against the pivot on a lower side of the latch and by the window on an upper side of the latch, and attaching an upper portion of the outer backshell to the lower portion of the outer backshell thereby retaining the handling tab within the slot. The upper portion of the outer backshell surrounding an upper portion of the inner backshell. The cabling includes the inner backshell that connects a cable that extends from a cable-side of the inner backshell to a cable connector that extends from a connector-side of the inner backshell. The lower portion of the outer backshell surrounds a lower portion of the inner backshell.

These and other embodiments, features, aspects, and advantages will become better understood with reference to the following description, appended claims, and accompanying drawings.

DETAILED DESCRIPTION

Figure 1:
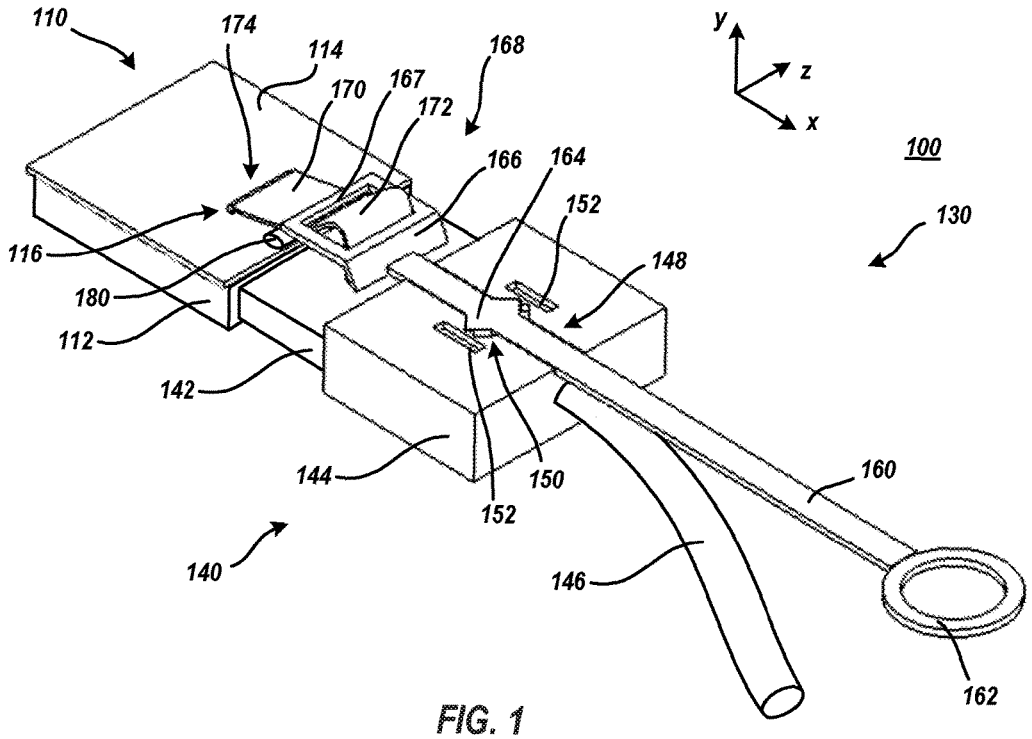
FIG. 1-FIG. 7 illustrate various views of a cable seating indication and retention system that indicates a cable is properly connected to an electronic system and retains the connected cable until the cable is deliberately removed, according various embodiments of the present invention.

A cable seating indication and retention system includes a cable connected to a latch that may be positioned in an engaged position or a disengaged position by a user manipulating a handling tab. To seat the cable to an electronic system, the handling tab is manipulated to position the latch in the disengaged position so that the cable may be seated to the electronic system. Once the cable is initially seated, the handling tab may be manipulated to position the latch in the engaged position to engage and retain the latch to a connector shell of the electronic system. The relative location of the handling tab, whether it be manipulated to position the latch in the engaged position or the disengaged position, provides a visible indication to a user whether the cable is properly seated.

Referring to the Drawings, wherein like numbers denote like parts throughout the several views, FIG. 1-FIG. 7 illustrate various views of a cable seating indication and retention system 100, hereinafter referred to as system 100.

System 100 includes a card connector assembly 110 and a cable assembly 130. The card connector assembly 110 includes at least an electronic system connector 112 and connector shell 114. Card connector assembly 110 is included within an electronic system and, in reference to the Figures, is generally fixed in the x, y, and z planes. Card connector assembly 110 may be included within an adapter card. The adapter card is a printed circuit board that may be inserted into an electrical connector, or expansion slot on a motherboard, backplane or riser card to add functionality to the electronic system. The connector 112 is connector that is accessible from the perimeter of the electronic system. For example, the adapter card installed within the electronic system forms a portion of the perimeter of the electronic system whereby the connector 112 may be accessed. Connector 112 includes electrically conductive pathways in communication with electrically conductive pathways of the adapter card.

The connector shell 114 is associated with the connector 112 and, as such, is used for shielding against electrical interference from connector 112, for preventing human access to connector 112, or for preventing physical damage of connector 112 due to environmental conditions, etc. For example, connector shell 114 may be a faraday shield generally surrounding exposed sides of the connector 112 to protect against, e.g. electromagnetic emissions of connector 112, etc. In a particular embodiment, an underside of connector 112 is installed or otherwise contacts the adapter card such that the electrically conductive pathways of the connector 112 are connected with the electrically conductive pathways of the adapter card. The upper side, sides, and rear of connector 112 are surrounded by connector shell 114. For clarity, only the upper side of connector shell 114 is shown in the FIG. 1-FIG. 7. The upper side of connector shell 114 includes one or more cutouts, indentations, receiving features, or the like, herein referred to as receiver 116 that receives one or more associated protrusions 174 of latch 170.

Cable assembly 130 includes cabling 140, handling tab 160, latch 170, pivot 180, and outer backshell 202, 204. Some of the components of cable assembly 130 are not depicted in various FIG. 1-FIG. 8. For example, connector 142 is depicted in FIG. 1 and not depicted in FIG. 2-FIG. 8 and outer backshell 202, 204 is not depicted in FIG. 1-FIG. 7 and is depicted in FIG. 8. For clarity, some components of cable assembly 130 are depicted in one or more figures and are not depicted in other figures to better highlight other components or features of cable assembly 130.

Cabling 140 includes cable 146, inner shell 144, and connector 142. Cable 146 includes one or more electrically conductive wires. The wires may be surrounded by an insulator which may be surrounded by a shield, which may be surrounded by an outer jacket. Inner shell 144 secures the cable 146 to the connector 142. Cable 146 generally extends from inner shell 144 in a x-axis direction away from connector 142.

The inner shell 144 is placed around a portion of the cable 146 and connector 142 which contains the facilities for attaching wires of the cable 146 to electrically conductive pathways of the connector 142. The inner shell 144 may be used for shielding against electrical interference from connector 142/cable 146, for preventing human access to connector 142/cable 146, or for preventing physical damage of connector 142/cable 146 due to environmental conditions, etc. For example, inner shell 144 may be a faraday shield generally surrounding the connections of the cable 146 wires to the connector 142 electrical pathways to protect against, e.g. electromagnetic emissions.

The inner shell 144 may include an upper portion and lower portion that may be fastened together and when positioned around the cable 146 and connector 142 to effectively secure the cable 142 and the connector 142. The size of the inner shell 144 varies with the connector 142 and the number of wires the cable 146 includes; the more wires the larger the inner shell 144.

The upper side or portion of shell 144 includes a slot 148. Slot 148 is a recess downward from the upper surface that extends from the front side to the rear side of inner shell 144 that accepts handling tab 160. The slot generally includes a x-axis dimension greater than a z-axis dimension. The slot is recessed giving it a z-axis dimension which is generally less than the z-axis dimension.

The upper side or portion of shell 144 also includes a dual-position receptacle 150. Receptacle 150 is a recess downward from the upper surface of inner shell 144 that accepts projection 164 of handling tab 160. Dual-position receptacle 150 is integral or contiguous to slot 148 and located within the bounds of the front side, rear side, right side, and left side of inner shell 144. Dual-position receptacle 150 generally has a first position nearest the cable 146 and a second position nearest connector 142.

The upper side or portion of shell 144 may further include one or more locating features 152 (e.g. recesses, protrusions, etc.) configured to accept, penetrate, etc. associated locating features of outer backshell to properly locate the outer backshell to cabling 140.

Handling tab 160 generally slides within slot 148 and is slidably retained to inner shell 144 by the outer backshell. In other words, handling tab 160 is positioned between inner shell 144 and the upper portion of the outer backshell. Handling tab 160 is a usability handle that which a user may engage, manipulate, or the like, (e.g., push, pull, etc.) to position latch 170 in a lock position or unlock position. The lock position or unlock position of latch 170 corresponds to an associated position of projection 164 within a particular position of dual-position receptacle 150. Handling tab 160 extends from the inner shell 144 in the x-axis direction. This enables the handling tab 160 to extend from the electronic system when the cable assembly is installed to the connector 112.

In an embodiment, dual-position receptacle 150 includes an interference fit portion that mechanically interferes with but does not prevent projection 164 slideably moving to the opposite position of dual-position receptacle 150. For example, projection 164 is configured to slightly bend, deform, or otherwise move upon it interfering with the interference fit portion such that the shape of projection 164 changes to no longer interfere with the interference fit portion thereby allowing projection 164 to move to the opposite position of dual-position receptacle 150.

In a particular implementation, when handling tab 160 is pulled and projection 164 is located in a positive x-axis position, the handling tab 160 and latch 170 are generally in the unlock position. Alternatively, when handling tab 160 is pushed and projection 164 is located in a negative x-axis position, the handling tab 160 and latch 170 are generally in the lock position.

When positioned within slot 148, one end of handling tab 160 extends outwardly from inner shell 144 in the general direction of cable 146 and may include a handle or finger pull 162. Finger pull 162 has an opening of sufficient size for a user to engage handling tab 160 with a finger. On the distal end, handling tab 160 includes flange 166. Flange 166 includes an opening 168 to accept latch vertex or ramp portion 172 of latch 170. Flange 166 is integral to the handling tab 160 and has a greater z-axis dimension relative to the z-axis dimension of the handling tab 160 that is configured to be slideable within slot 148. Though latch 170 is generally positioned below or underneath flange 166, the ramp portion 172 extends from latch 170 to above flange 166 through window 168. When the user pulls handling tab 160, a particular pulling edge 167 of window 170 contacts ramp portion 172 and rotates latch 170 about pivot 180 dissociating protrusion 174 of latch 170 from receiver 116. Pulling edge 167 generally has a z-axis dimension greater than a z-axis dimension of latch 170.

Handling tab 160 is generally made of a material having tensile stress and strain properties such that handling tab 160 does not dimensionally elongate or compress when handling tab is engaged by a user. For example, handling tab 160 may be formed from molded plastic, etc.

Latch 170 is a fastener that fastens the cable assembly 130 to the electronic device by the protrusion 174 being engaged with receiver 116. The latch 170 generally fastens the cable assembly 130 to the electronic device and limits movement of the cable assembly 130 from the electronic device in the x-axis direction. In other words, the latch 170 retains the cable assembly to the electronic device. For example, when cable 146 is pulled from the electronic system, without the user first manipulating the handling tab 160 and latch 170 into the unlock position, the protrusion 174 maintains its engagement with receiver 116 and the connector 142 is retained to connector 112.

Latch 170 is generally retained within the outer backshell by the ramp portion 172 extending through window 168 on a top side of latch 170 and by the pivot 180 on the bottom side of latch 170. For example, when ramp portion 172 is positioned within window 168, the window 168 retains the latch from moving in the x-axis, z-axis, and from moving upward in the y-axis; wherein the latch 170 is still able to rotate about axis 180. In an embodiment, a spring 171, as exemplarily depicted in FIG. 7, may contact the latch 170 and force the latch 170 into the lock position as a default position. Latch 170 is generally made of a material having tensile stress properties such that latch 170 does not dimensionally elongate when the cable 146 pulled from the electronic system. For example, latch 170 may be formed from sheet metal, etc.

Latch 170 includes protrusion 174 and ramp portion 172. Protrusion 174 is generally an elongated portion of latch 170 that extends into and is accepted by receiver 116. Protrusion 174 may be multiple elongated portions of latch 170 that correspond to multiple receivers 116 when cable assembly 130 is installed to the electronic system. For example, if receiver 116 includes two cutouts of connector shell 114, protrusion 174 includes to elongated portions that are each individually accepted by a cutout. Protrusion generally has a y-axis dimension smaller than a z-axis dimension of latch 170. Protrusion 174 and a portion of ramp portion 172 may extend outward from the outer backshell. In other words, protrusion 174 and a portion of ramp portion 172 may not be enclosed by the outer backshell and may be exposed. In other implementations, protrusion 174 is enclosed within the outer backshell. Ramp portion 172 may have a first upward sloped portion so that the latch 170 may extend upward through window 168 of handling tab 160. Ramp portion 172 may also have a second downward sloped portion so the latch 170 may extend downward through window 168. The first sloped portion is connected to the second sloped portion by a vertex. The vertex is generally above the window 168 opening by a height greater than the expended travel length of the handling tab.

Figure 3:
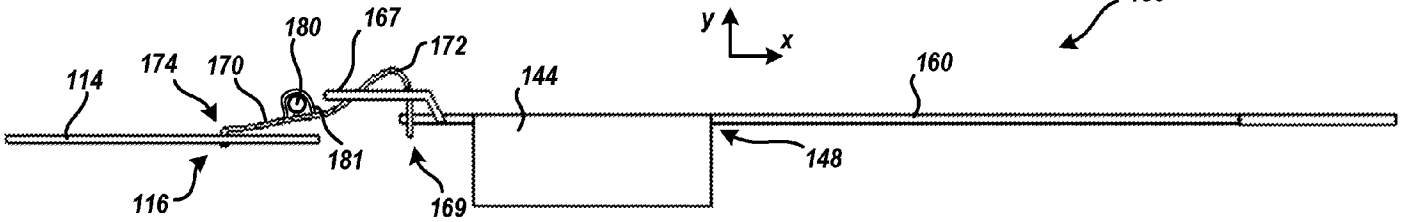

Pivot 180 is an rotational axle, pin, or the like, that causes rotation of latch 170 and resulting disengagement of protrusion 174 from receiver 116 when pulling edge 167 of window 170 contacts ramp portion 172 when handing tab 160 is pulled in the direction away from the electronic system. As shown in FIG. 3, the latch 170 may include a pivot retention member 181 with an opening that is generally orthogonal to the length of latch 170. The pivot retention member 181 generally retains the latch 170 to the pivot 180 in the x-y plane while allowing the latch 170 to rotate about pivot 180 in a z-axis. The opening of retention member 181 generally accepts pivot 180. Pivot retention member 181 may be a boss, or the like. Pivot 180 has a z-axis dimension greater than the z-axis dimension of latch 170. In an embodiment, pivot 180 has a z-axis dimension such that pivot may be attached to x,y plane sides of outer back shell.

Cable assembly 130 may be formed or otherwise fabricated by a fabrication method. The outer backshell may be separated into the upper portion and lower portion. The handling tab 160 may be installed into the inner backshell 144. For example, the handling tab 160 may be inserted into slot 148 wherein the projection 164 fit within a recess of the dual-position receptacle 150. The handling tab 160 and inner backshell 144 combination may be installed into the upper portion of the outer backshell. Locating features of the upper portion of the outer backshell may engage with locating features 152 of inner backshell 144. Subsequently, the latch 170 is positioned within window 168. For example, ramp portion 172 is inserted through window 168. Subsequently, the pivot 180 is connected to the upper portion of the outer backshell. For example, the pivot 180 may be clipped, inserted, or otherwise attached to the upper portion of the outer backshell to generally retain the latch 170. In another implementation, the pivot 180 is attached to latch 170 and the pivot 180 and latch combination is installed to the upper portion of the outer backshell. Subsequently, the lower portion of the outer backshell may be installed to the upper portion of the outer backshell and may generally enclose the connector 142, inner backshell 144, portion of the handling tab 160, flange 166, latch 170, and pivot 180. A portion of the handling tab 160 and cable 146 extends away from connector 142 external from the outer backshell.

Figure 2:
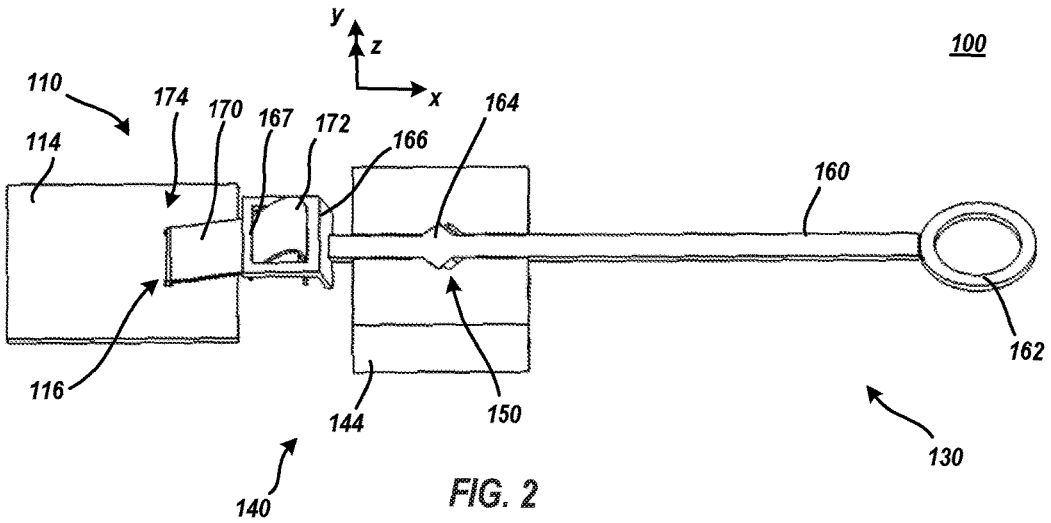

FIG. 2 and FIG. 3 depict the cable assembly 130 previously installed to the electronic system with the handling latch 160, and resultantly, latch 170 positioned in the lock position. The cable assembly 130 is installed to the electronic system by the user seating connector 142 of the cable assembly 130 to connector 112 of the electronic system. During the seating of connector 142 to connector 112, the handling tab 160 is generally located in the unlock position and once seated the handling tab may be manipulated to the lock position. The location of receiver 116 upon connector shell 114 is such that the protrusion 174 is received by receiver 116 only when the connector 142 is adequately seated to connector 112.

When positioned in the lock position, the second sloped portion of ramp portion 172 than extends down through window 168 may further engage with the flange 166 or through a flange side opening 169 or notch, slot, etc. of handling tab 160, as is shown on FIG. 3, to reduce or prevent latch 170 from undesirably rotating about pivot 180 from the locked position to the unlocked position when the handling tab 160 is not likewise manipulated.

Further when positioned in the lock position, there may be clearance between the ramp portion 172 and pulling edge 167. In other words, when positioned in the lock position, pulling edge 167 of window 168 may not contact ramp portion 172. Further, when seating connectors 112, 142, and in those embodiments where the latch 170 is spring loaded, the spring 171 may exert a force against the latch to rotate latch 170 to the locked position when there is clearance between the latch 170 and connector shell 114—i.e. when protrusion 174 may be received by receiver 116.

When the cable assembly 130 is installed to the electronic position and the latch is in the locked position, latch 170 is generally prevented from rotating about pivot 180 and cable assembly 130 is retained to the electronic system. Further, the position of handling tab 160 in that projection 164 is located in the lock position of receptacle 150 serves as a visual indication to the user that connector 142 is properly seated to connector 112.

Figure 4:
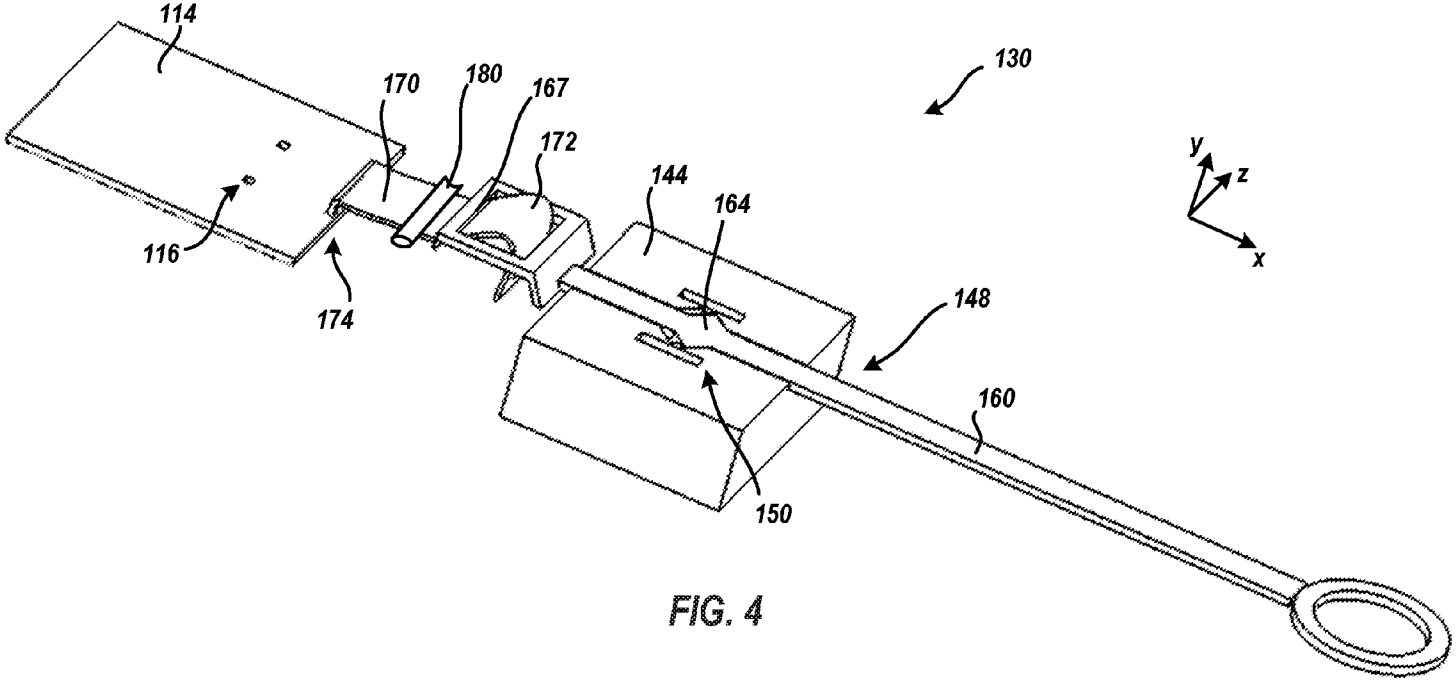
Figure 5:
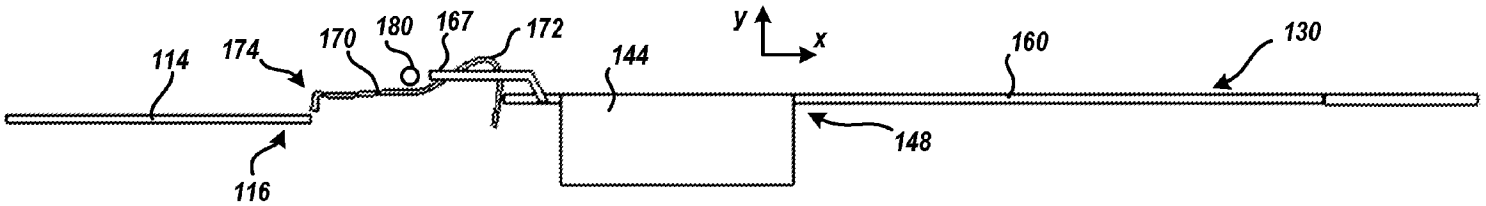

FIG. 4 and FIG. 5 depict the cable assembly 130 uninstalled from the electronic system with the handling latch 160, and resultantly, latch 170 positioned in the unlock position. The cable assembly 130 is uninstalled from the electronic system by the user unseating connector 142 of the cable assembly 130 from connector 112 of the electronic system. Prior to the unseating of connector 142 from connector 112, the handling tab 160 is generally manipulated to be located in the unlock position. When manipulated to the unlock position, the pulling edge 167 contacts ramp portion 172 causing a moment upon the latch about pivot 180 thereby rotating the latch 170 away from the connector shell 114. The rotation of latch 170 disengages the protrusion 174 from receiver 116 such that cable assembly 130 is no longer retained to the electronic system by latch 170.

When unseating connectors 112, 142, and in those embodiments where the latch 170 is spring loaded, the moment upon latch 170 about pivot 180 is greater than the spring 171 force against the latch to rotate latch 170 to the locked position. In other words, when handling tab 160 is manipulated to the unlock position, the spring force is overcome and the latch 170 rotates disengaging protrusions 174 from receiver 116. When in the unlock position, the second sloped portion of ramp portion 172 that extends down through window 168 generally disengages with the flange side opening 169.

Figure 6:
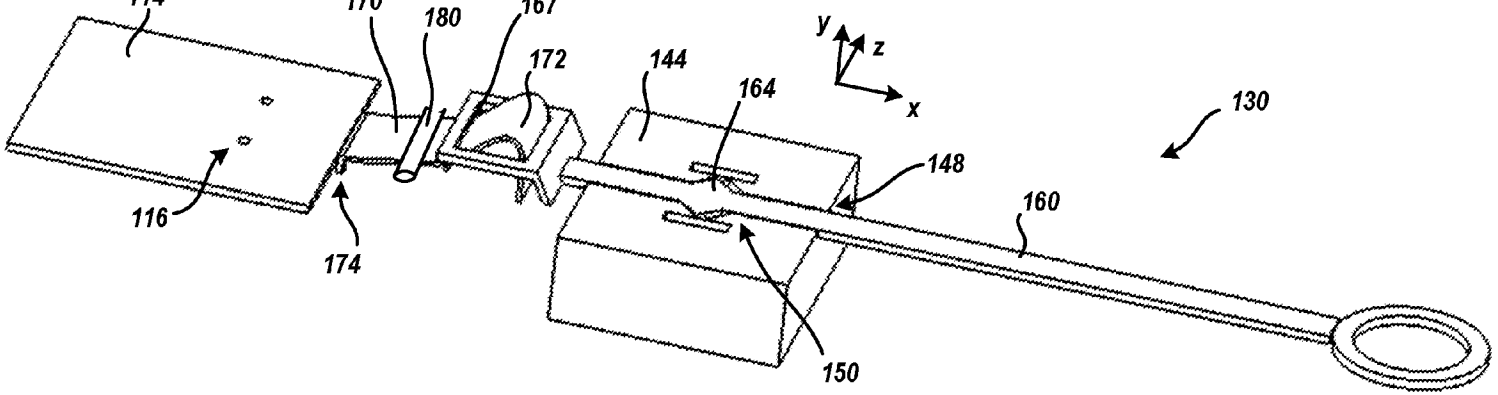
Figure 7:
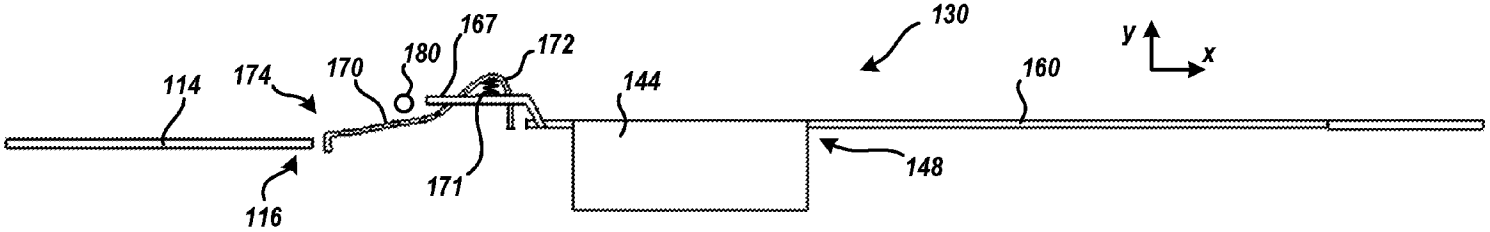
Figure 8:
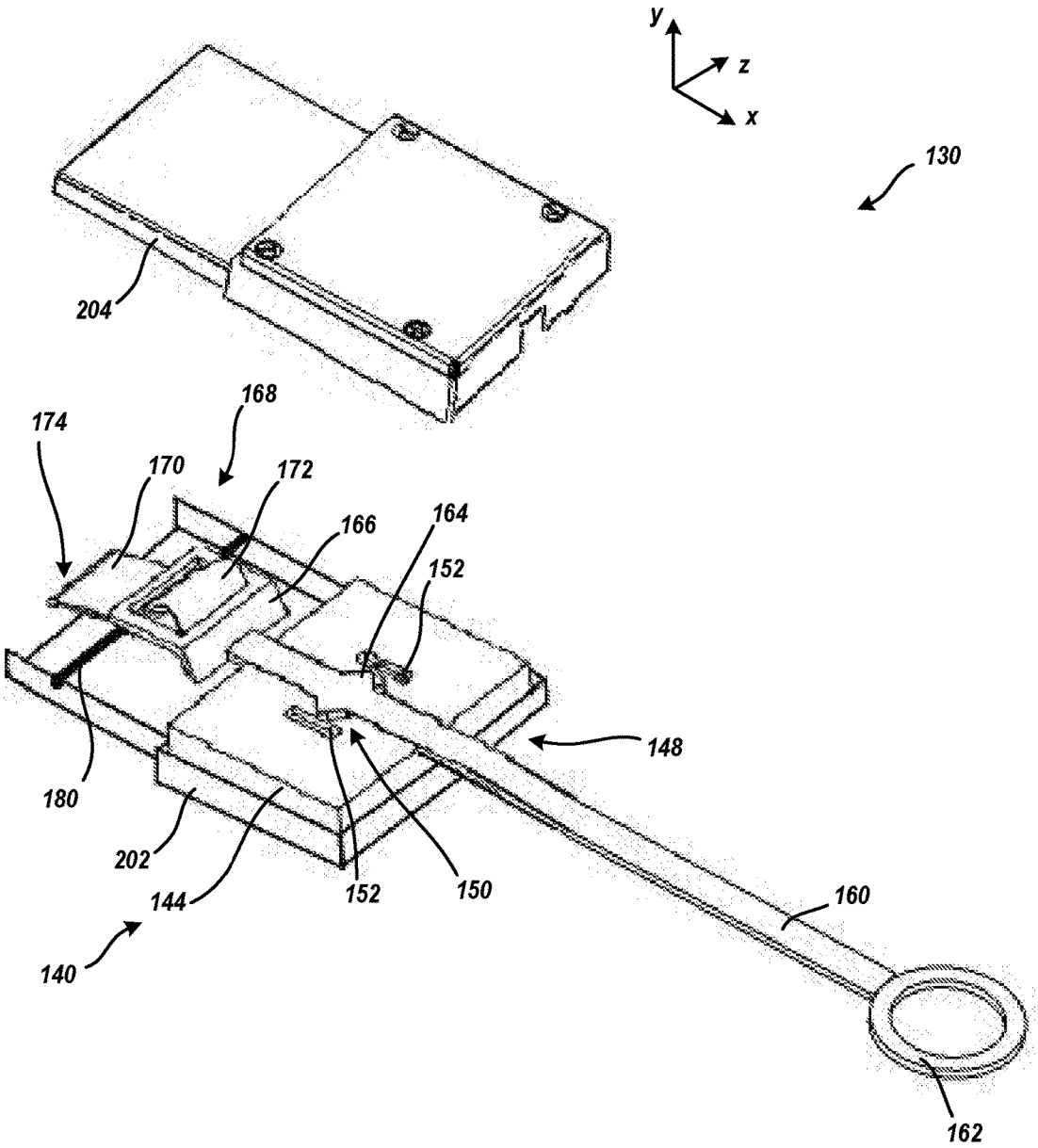
FIG. 8 illustrates a cable assembly including connector backshell, latch, pivot, cabling, and handling tab, according various embodiments of the present invention.

FIG. 6 and FIG. 7 depicts the handling tab 160, and resultantly latch, 170 in the lock position when the cable assembly 130 is attemptedly being installed to the electronic system. In such an attempt to install the cable assembly 130 to the electronic device in the lock position, the latch 170 contacts or otherwise mechanically interferes with the connector shell 114 preventing the seating of connector 142 with connector 112.

FIG. 8 illustrates an exploded view of cable assembly 130 which includes connector outer backshell 202, 204, latch 170, pivot 180, cabling 140, and handling tab 160, according various embodiments of the present invention. Connector outer backshell 202, 204 is the outermost backshell of the cable assembly and may be used for preventing human access to or to prevent damage to the cabling 140 components within the outer backshell 202,204. Connector outer backshell 202, 204 may be formed from molded plastic. Further, connector outer backshell 202, 204 generally surrounds cabling 140 components and retains pivot 180.

In a particular cable assembly 130 fabrication method, the outer backshell is separated into the upper portion 204 and lower portion 202. Pivot 180 is installed or retained to lower portion 202. In some embodiments, pivot 180 may be clipped into the lower portion or may be inserted into clearance holes in sidewalls of lower portion 202 and retained therein with one or more retainer clips. In some embodiments, pivot 180 is forceably inserted into interference-fit clearance holes in sidewalls of lower portion 202 and is generally fixed with respect thereto.

The cabling 140 may subsequently be installed into the lower portion 202. The lower side or portion of shell 144 may further include one or more locating features 152 (e.g. recesses, protrusions, etc.) configured to accept, penetrate, etc. associated locating features of lower portion 204 to properly locate the outer backshell portion 202 to the inner backshell 140.

The latch 170 is positioned within window 168 of handling tab 160. For example, ramp portion 172 is inserted through window 168. The handling tab 160 is installed into the inner backshell 144. For example, the handling tab 160 may be inserted into slot 148 wherein the projection 164 fits within a recess of the dual-position receptacle 150. By installing the handling tab 160 to inner backshell 140, the latch 170 is retained by the pivot 180 on its lower side and by the window 168 on its upper, right, left, front, and rear sides.

Subsequently, the upper portion 204 of the outer backshell may be installed to the lower portion 202 of the outer backshell and may generally enclose the a portion of connector 142, inner backshell 144, a portion of the handling tab 160, flange 166, a portion of latch 170, and pivot 180. A portion of the handling tab 160 and cable 146 generally extends away from connector 142 external from the outer backshell portions 202, 204.

Figure 9:
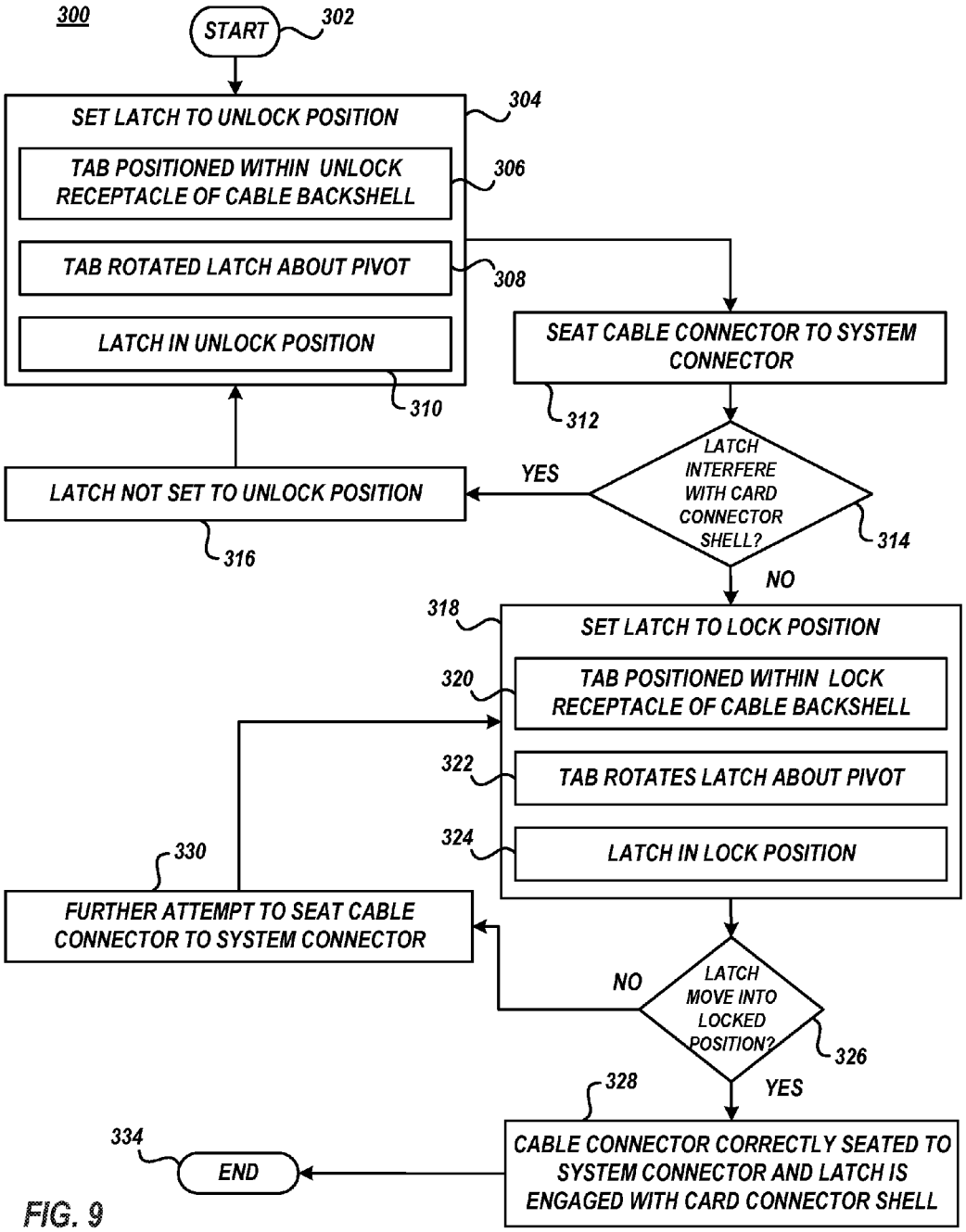
FIG. 9 illustrates an exemplary method of seating and retaining a cable to an electronic system, according to various embodiments of the present invention.

FIG. 9 illustrates an exemplary method 300 of seating and retaining a cable to an electronic system and visually indicating the proper seating thereof, according to various embodiments of the present invention. Method 300 may be performed e.g., by a user such as a service technician that services an electronic system.

Method 300 begins at block 302 and continues with setting the latch 170 to the unlock position (block 304). The latch 170 may be set to the unlock position by manipulating the handling tab 160 such that projection 164 of handling tab 160 is moved to or otherwise is positioned in the associated unlock position within the dual-position receptacle 150 (block 306). With the latch 170 being set to the unlock position, latch 170 is rotated about pivot 180 (block 308) and the protrusion 174 of latch 170 is disengaged from receiver 116 (block 310).

Method 300 may continue by seating cable 142 with electronic system connector 112 (block 312). For example, the cable assembly 130 is installed to the electronic system such that conductive features of one connector contact features of the other connector with a predetermined adequate swipe or overlap.

Method 300 may continue by determining if the latch 170 has contacted or interfered with the card connector shell 114 (block 314). For example, protrusion 174 will contact the side of the card connector shell 114 if the latch 170 isn't properly positioned in the unlock position when the cable assembly 130 is installed to the electronic system. If the latch 170 has contacted or interfered with the card connector shell 114, the latch 170 is not properly set to the unlock position (block 316) and method 300 returns to block 304.

If the latch 170 has not contacted or interfered with the card connector shell 114, cable 142 is properly seated with electronic system connector 112 and the latch 170 may be set to the lock position (block 318). The latch 170 may be set to the lock position by manipulating the handling tab 160 such that projection 164 of handling tab 160 is moved to or otherwise is positioned in the associated lock position within the dual-position receptacle 150 (block 320). With the latch 170 being set to the lock position, latch 170 is rotated about pivot 180 (block 322) and the protrusion 174 of latch 170 is engaged or otherwise received by receiver 116 (block 324).

Method 300 may continue by confirming whether latch 170 has moved into the locked position (block 326). For example, a visual inspection of the position of handling tab 160 indicates whether latch 170 has moved into the lock position. In the visual inspection of the handling tab 160 it is known that the latch 170 is in the lock position if the handling tab is in the lock position that is most toward the electronic system. If the latch 170 has moved into the locked position, the cable connector 142 is correctly seated to the electronic system connector 112 and the protrusion 174 of latch 170 is engaged with receiver 116 of card connector shell 114 (block 328) and the cable assembly 130 is retained to electronic system.

If the latch 170 has not moved into the locked position, another attempt at seating the cable connector 142 to the electronic system connector 112 is performed (block 330) since the cable connector 142 is incorrectly seated to the electronic system connector 112 and the protrusion 174 of latch 170 is not engaged with receiver 116 of card connector shell 114. Method 300 ends at block 334.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over those found in the marketplace, or to enable others of ordinary skill in the art to understand the embodiments disclosed herein.

What is claimed is:

1. A cable assembly comprising:

an inner backshell that connects a cable that extends from a cable-side of the inner backshell to a connector that extends from a connector-side of the inner backshell, the inner backshell comprising: a slot recessed from an upper side and between the cable-side and connector side of the inner backshell and a dual-position receptacle comprising dual positions, wherein the dual-position receptacle is recessed from the upper side of the inner backshell and contiguous with the slot;

a handling tab that extends from the cable side of the inner backshell and is positioned within and slideable against the slot in a first direction from the cable-side of the inner backshell to the connector-side of the inner backshell and in a second direction from the connector-side of the inner backshell to the cable-side of the inner backshell, the handling tab comprising: a projection within the dual-position receptacle and a windowed flange comprising a cutout window through the windowed flange, wherein the windowed flange extends from the connector-side of the inner backshell toward the cable connector;

a latch comprising an upward ramp and a downward ramp, wherein the upward ramp extends upwards from below the cutout window of the windowed flange to a pulling edge portion of the upward ramp that contacts a pulling edge of the cutout window of the windowed flange to a latch vertex above the cutout window of the windowed flange, wherein the downward ramp extends downwards from the latch vertex to below the cutout window of the windowed flange, and wherein the latch further comprises a protrusion at the distal end of the upward ramp relative to the latch vertex; and a pivot that contacts the latch between the pulling edge portion of the upward ramp and the protrusion.

2. The cable assembly of claim 1, wherein the latch rotates about the pivot.

3. The cable assembly of claim 2, wherein changing positions of the projection within the dual-position receptacle rotates the latch about the pivot.

4. The cable assembly of claim 3, pulling edge of the cutout window of the windowed flange contacts the pulling edge portion of the upward ramp and rotates the latch when the projection is changed from a connector-side position of the dual-position receptacle to a cable-side position of the dual-position receptacle.

5. The cable assembly of claim 1, further comprising:

an outer backshell that surrounds the inner backshell and retains the handling tab within the slot.

6. The cable assembly of claim 5, wherein the pivot is attached to the outer backshell.

7. The cable assembly of claim 1, wherein the dual-position receptacle comprises an interference fit portion that mechanically interferes with but does not prevent the projection slideably moving to and from the dual positions of dual-position receptacle.

8. An electronic system comprising:

an electronic system connector accessible from outside an associated electronic system perimeter;

an electronic system connector shell associated with the electronic system connector, the electronic system connector shell comprising a receiving feature; and a cable assembly comprising:

an inner backshell that connects a cable that extends from a cable-side of the inner backshell to a cable connector that extends from a connector-side of the inner backshell, the inner backshell comprising: a slot recessed from an upper side and between the cable-side and connector side of the inner backshell and a dual-position receptacle comprising dual positions, wherein the dual-position receptacle is recessed from the upper side of the inner backshell and contiguous with the slot;

a handling tab that extends from the cable side of the inner backshell and is positioned within and slideable against the slot in a first direction from the cable-side of the inner backshell to the connector-side of the inner backshell and in a second direction from the connector-side of the inner backshell to the cable-side of the inner backshell, the handling tab comprising: a projection within the dual-position receptacle and a windowed flange comprising a cutout window through the windowed flange, wherein the windowed flange extends from the connector-side of the inner backshell toward the cable connector;

a latch comprising an upward ramp and a downward ramp, wherein the upward ramp extends upwards from below the cutout window of the windowed flange to a pulling edge portion of the upward ramp that contacts a pulling edge of the cutout window of the windowed flange to a latch vertex above the cutout window of the windowed flange, wherein the downward ramp extends downwards from the latch vertex to below the cutout window of the windowed flange, and wherein the latch further comprises a protrusion at the distal end of the upward ramp relative to the latch vertex; the protrusion configured to engage the receiving feature when the cable connector is seated with the electronic system connector; and a pivot that contacts the latch between the pulling edge portion of the upward ramp and the protrusion.

9. The electronic system of claim 8, wherein the latch rotates about the pivot.

10. The electronic system of claim 9, wherein changing positions of the projection within the dual-position receptacle rotates the latch about the pivot.

11. The cable assembly of claim 3, pulling edge of the cutout window of the windowed flange contacts the pulling edge portion of the upward ramp and rotates the latch when the projection is changed from a connector-side position of the dual-position receptacle to a cable-side position of the dual-position receptacle and resultantly disengages the protrusion from the receiving feature.

12. The electronic system of claim 8, further comprising:

an outer backshell that surrounds the inner backshell and retains the handling tab within the slot.

13. The electronic system of claim 12, wherein the pivot is attached to the outer backshell.

14. The electronic system of claim 8, wherein the dual-position receptacle comprises an interference fit portion that mechanically interferes with but does not prevent the projection slideably moving to and from the dual positions of dual-position receptacle.

15. A method of fabricating a cable assembly comprising:

attaching a pivot into a lower portion of an outer backshell;

positioning cabling into the lower portion of the outer backshell, the cabling comprising an inner backshell that connects a cable that extends from a cable-side of the inner backshell to a cable connector that extends from a connector-side of the inner backshell, the lower portion of the outer backshell surrounding a lower portion of the inner backshell;

positioning a latch comprising an upward ramp and a downward ramp, wherein the upward ramp extends upwards from below a cutout window of a windowed flange of a handling tab, to a pulling edge portion of the upward ramp that contacts a pulling edge of the cutout window of the windowed flange to a latch vertex above the cutout window of the windowed flange, wherein the downward ramp extends downwards from the latch vertex to below the cutout window of the windowed flange, and the windowed flange extends from the connector-side of the inner backshell toward the cable connector, positioning the handling tab into a slot that is recessed from an upper side of the inner backshell thereby retaining the latch against the pivot on a lower side of the latch such that the pivot contacts the latch between the ramp portion and a protrusion of the latch at the distal end of the latch relative to the ramp portion and thereby retaining the latch against the window cutout on an upper side of the latch, wherein the handling tab is positioned in the slot such that the handing tab is slideable against the slot in a first direction from the cable-side of the inner backshell to the connector-side of the inner backshell and in a second direction from the connector-side of the inner backshell to the cable-side of the inner backshell; and attaching an upper portion of the outer backshell to the lower portion of the outer backshell thereby retaining the handling tab within the slot, the upper portion of the outer backshell surrounding a upper portion of the inner backshell.

16. The method of claim 15, further comprising:

attaching a spring to the latch to rotate the latch against the pivot to a default position.

17. The method of claim 15, wherein positioning the handling tab into the slot of the inner backshell comprises:

positioning a projection of the handling tab within a dual-position receptacle comprising dual positions, wherein the dual-position receptacle is recessed from the upper side of the inner backshell and contiguous with the slot.

* * * * *